US005619926A

United States Patent [19]

Engelmann et al.

[11] Patent Number: 5,619,926

[45] Date of Patent: Apr. 15, 1997

[54] DEVICE FOR SUPPLYING PRINTING PLATES IN A PRINTING MACHINE

[75] Inventors: Rüdiger Engelmann, Rauenberg; Hans-Jürgen Kusch, Neckargemünd; Paul Nicola; Peter Marten, both of Heidelberg; Rudi Stellberger, Kronau; Volker Bergen, Wiesloch; Bernd Ruf, Weiterstadt, all of Germany

[73] Assignee: Heidelberger Druckmaschinen AG, Heidelberg, Germany

[21] Appl. No.: 543,158

[22] Filed: Oct. 13, 1995

[30] Foreign Application Priority Data

Oct. 13, 1994 [DE] Germany ..... 44 36 559.4

[51] Int. Cl.[6] ..... B41F 27/06

[52] U.S. Cl. ..... 101/477; 101/415.1

[58] Field of Search ..... 101/415.1, 477, 101/382, 216

[56] References Cited

U.S. PATENT DOCUMENTS

| | | | |
|---|---|---|---|
| 5,074,212 | 12/1991 | Kobler et al. . | |
| 5,289,775 | 3/1994 | Spiegel et al. . | |
| 5,299,498 | 4/1994 | Spiegel et al. . | |
| 5,443,006 | 8/1995 | Beisel et al. . | |
| 5,454,317 | 10/1995 | Kobler et al. | 101/477 |

FOREIGN PATENT DOCUMENTS

| | | |
|---|---|---|
| 38216/93 | 11/1993 | Australia . |
| 0268857 | 6/1988 | European Pat. Off. . |
| 0567754 | 11/1993 | European Pat. Off. . |
| 4003445 | 12/1991 | Germany . |
| 4130359 | 3/1993 | Germany . |
| 4327013 | 1/1995 | Germany . |
| 59-22755 | 2/1984 | Japan . |
| 61-248834 | 11/1986 | Japan . |
| 6-8402 | 1/1994 | Japan . |
| 94/06631 | 3/1994 | WIPO . |

*Primary Examiner*—Eugene H. Eickholt
*Attorney, Agent, or Firm*—Herbert L. Lerner; Laurence A. Greenberg

[57] ABSTRACT

The device for supplying printing plates to plate cylinders of printing machines includes elements for holding and for guiding printing plates. The plates can thereby be supplied to at least two different plate cylinders. The plate-holding assembly can thereby be pivoted into at least two different plate changing positions for feeding (and removing) printing printing plates at at least two printing units.

16 Claims, 2 Drawing Sheets

2
2'
1,14
23
1
4
15
16
25
24
15
16
18
10
3
21
5
7
8
9
17
13
22
26
22
12
21
6
11

DEVICE FOR SUPPLYING PRINTING PLATES IN A PRINTING MACHINE

BACKGROUND OF THE INVENTION

Field of the Invention

The invention relates to a device for supplying printing plates to plate cylinders of printing presses.

A device for supplying printing plates to plate cylinders of printing presses has been heretofore known from European patent publication EP 0 567 754 A1, in which a roller is provided for guiding the printing plate and a suction cup for holding the printing plate end. This device can only take on one plate-changing position, and printing plates can be supplied to only one plate cylinder.

While the aforementioned device is quite suitable and well tested, it has so far not been possible with a plate feeder of that type to allow for a plurality of positions such that the plates may be supplied to more than just a single cylinder.

SUMMARY OF THE INVENTION

It is accordingly an object of the invention to provide a device for supplying printing plates to plate cylinders of printing presses, which overcomes the above-mentioned disadvantages of the heretofore-known devices and methods of this general type and which makes it possible with the addition of an element for holding and guiding the printing plates to supply the printing plates to at least two plate cylinders.

With the foregoing and other objects in view there is provided, in accordance with the invention, a combination of a printing press having plurality of plate cylinders, with a device for supplying printing plates to the plate cylinders of the printing press, comprising:

a plate-holding device for holding and guiding a printing plate disposed at the printing press, and means operatively associated with the plate-holding device for allowing the plate-holding device to be brought into different plate-changing positions at at least two printing units, for selectively supplying printing plates to the at least two printing units.

In accordance with a further feature of the invention, the device comprises feed elements, the plate-holding device, in its plate-changing positions, being in operative engagement with the feed elements.

In other words, the objects of the invention are solved in that a plate-holding device which holds and guides a printing plate is arranged at the printing press in such a way that it can be brought into plate-changing positions for plate supply to at least two printing units.

The advantage of the invention is found in the simple construction and the low cost of the system. This becomes particularly clear from the fact that there is required only one plate-holding device for changing the printing plates on a plurality of plate cylinders. Performing a plate exchange has become easier for the operator, since he or she can insert the new printing plates for a plurality of plate cylinders in the same location at the machine.

The supply of printing plates can take place in that the plate-holding device itself is equipped with feed elements or in that the plate-holding device, in its plate-changing positions, is operatively connected with feed elements assigned to these positions. In the latter case it is possible to construct these feed elements to be different from one another, thereby allowing spatial conditions to be taken into account.

Of particular interest is an embodiment of the invention which provides for the plate-holding device to also serve in the discharge of the printing plates from the printing units. Thus, the printing plate discharge practically takes place in the same plate-changing position as the feed of printing plates.

In a further preferred embodiment, the plate-holding device is swivelably arranged at the cylinder guard. The feed elements can be mounted at the cylinder guard as well. If, in addition, there is a swivel arrangement of the cylinder guard at the machine frame, the elements serving the printing plate change can be swung out of the machine by opening the cylinder guard. In this way, optimal access to the plate cylinders by way of opening the cylinder guard is ensured.

The plate-holding device can be designed as plate supply table serving as a support for manual plate supply. Additionally, the plate supply table can receive discharged printing plates. It also is feasible, however, that the plate-holding device is designed as a magazine for holding a plurality of printing plates to be supplied and possibly also for receiving multiple discharged printing plates. More information with regard to printing plate magazines may be found in U.S. Pat. Nos. 5,289,775 and 5,299,498 which are herein incorporated by reference.

The printing units, wherein the printing plate change is performed by means of the device according to the invention, can be two or multiple identically designed printing units, and at least one of the printing units can be brought into an engaged and a disengaged position by means of a swivel arrangement. It may also be a main printing unit and at least one disengageable additional printing unit.

Such machines usually are small offset printing presses for printing one or two colors: they require a low-cost structure for the plate-changing device for economic reasons. The device according to the invention satisfies this requirement.

An especially quick printing plate exchange is achieved in that position detection elements and control elements are arranged in such a way that the machine is steered into the plate-changing positions in the most advantageous sequential order. For example, there can be provided that a microswitch or sensor (e.g. light gate, pulsed light gate array, etc.) detects the position of the plate-holding device, and the control elements first bring the plate cylinder, at which the plate-holding device is in a working position, into the plate-changing position. When the plate exchange has taken place, the next plate cylinder is steered into the plate-changing position, after the plate-holding device has been swivelled into the plate-changing position for this cylinder.

In accordance with a further embodiment, at least one of the feed elements is equipped with guiding tongues for guiding the printing plates at their side edges. In this manner a secure supply of printing plates to the plate cylinders can be achieved, even when the plate cylinder is arranged deeply in the machine, and when—in the event of a manual supply of the printing plates to the clamping and locking mechanism of the plate cylinder—the feeding process cannot be observed visually. The guiding tongues can be designed so as to be swivelable, in order to allow for skewed placing of printing plates for register correction. This swivel motion of the guiding tongues is also required for the discharge of such skewed printing plates.

Instead of discharging used printing plates onto the plate-holding device, it is also feasible to provide separate discharge compartments. Such a separate discharge compartment can also be provided for a plate cylinder. This is especially useful if the used printing plate, with its image side, were to be discharged onto the plate supply table. In such a case a separate discharge compartment prevents the plate supply table from being soiled with ink.

One exemplary embodiment provides that in the one plate-changing position the supply to and the discharge from the plate cylinder of the one printing unit takes place at the one side of the plate supply table, that after the plate supply table is swivelled into the second plate-changing position the supply of a printing plate to the plate cylinder of the other printing unit takes place at the other side of the plate supply table, and that the discharge of a printing plate from the additional printing unit takes place through of a separate discharge compartment.

Other features which are considered as characteristic for the invention are set forth in the appended claims.

Although the invention is illustrated and described herein as embodied in a device for supplying printing plates to plate cylinders of printing presses, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
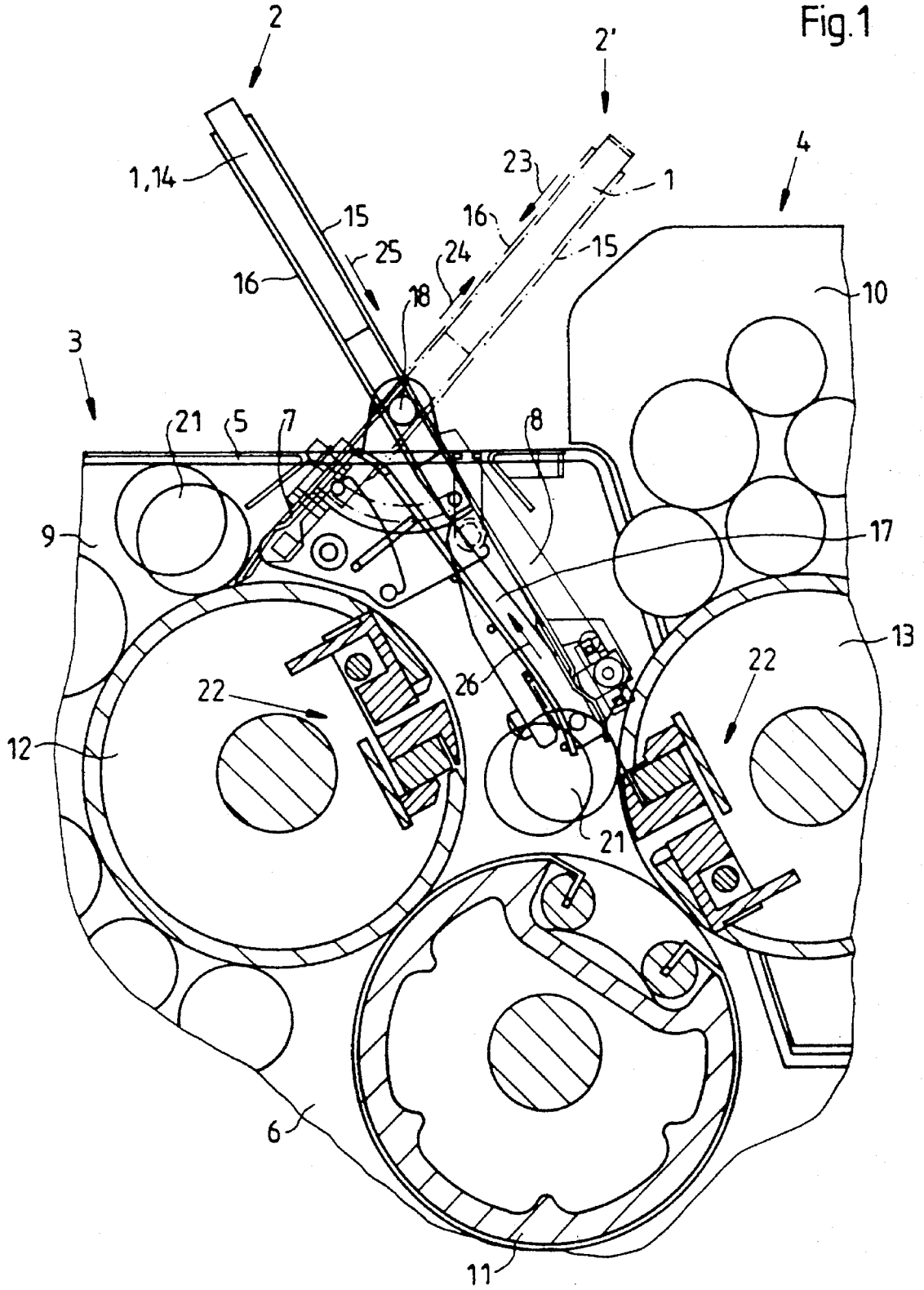
FIG. 1 is a partial sectional view of a printing press with the device according to the invention and two plate cylinders.

Referring now to the figures of the drawing in detail and first, particularly, to FIG. 1 thereof, there is seen a section of a printing press with two printing units 3 and 4. The printing unit 4 can be brought into a disengaged position through a swivel arrangement. The printing units 3 and 4 can either be identical or they can be a main printing unit 9 and an additional printing unit 10 (for the sake of simplicity we will presume the second possibility in the following). A plate-holding device 1, i.e. a plate supply table 14, can assume a plate-changing position 2 and a plate-changing position 2' (shown by a dash-dotted line in FIG. 1). For this purpose the plate-holding device 1 is fastened to a cylinder guard 5 by means of a swivel mechanism 18. In the plate-changing position 2 the plate-holding device 1 is in operative contact with a feed element 8 for supplying a new printing plate to a plate cylinder 13 of the additional printing unit 10. In the plate-changing position 2' the plate-holding device 1 is in operative engagement with a feed element 7 for supplying a new printing plate to the plate cylinder 12 of the main printing unit 9. Due to given spatial conditions, the feed elements 7 and 8 are of different construction. This pays tribute to the fact that the plate cylinder 13 of the additional printing unit 10 is situated deeper in the machine than the plate cylinder 12 of the main printing unit 9. Thus, the feed element 8, accordingly, is longer, which compensates for the greater space between the plate-holding device 1 and the plate cylinder 13. On both feed elements 7 and 8 there can be disposed rollers 21, which provide for additional guidance of the printing plates.

The printing plate exchange takes place as follows: In the plate-changing position 2' for printing plate changing in the main printing unit 9 the side 16 of the plate supply table 14 is on top, whereon the supply 23 of the new printing plate as well as the discharge 24 of the old printing plate takes place. In both cases the printing plate lies with its image side up on the side 16 of the plate supply table 14.

In the plate-changing position 2 for printing plate exchange in the additional printing unit 10 the side 15 of the plate supply table 14 is on top. Onto this side 15 the printing plate, for supply 25, has to be laid with its image side down, in order to achieve correct mounting of the printing plate on the plate cylinder 13. A discharge compartment 17 is provided for the purpose of discharging the old printing plate from the plate cylinder 13. The reason therefor is that otherwise a printing plate to be discharged would be deposited on the plate supply table 14 with its image side down. This could cause soiling of the plate supply table 14 and, consequently, of the new printing plates to be supplied in the following. In providing the discharge compartment 17 such soiling is prevented.

FIG. 1 further shows a blanket-cylinder 11 which can receive a two-color printing image through the two plate cylinders 12 and 13, in order to transfer it to the printing material on a non-illustrated impression cylinder. The plate cylinders 12 and 13 are equipped with a clamping and locking mechanism 22 for mounting the printing plates. For the change of printing plates this clamping and locking mechanism 22 releases a printing plate to be removed at its rear or trailing edge, and the printing plate is moved, by rotating the plate cylinder 12 or 13 into a discharge direction indicated by the arrow 24 or 26, until a position is reached wherein the leading edge of the printing plate can also be released from the clamping and locking mechanism 22. The feed and mounting of the new printing plates takes place in the same position of the plate cylinder 12 or 13 and of the plate-holding device 1, in which the respective old printing plates are discharged. For supply, these printing plates are pushed in the direction of the plate cylinder 12 or 13 (as shown by the arrows 23 and 25, until the leading edge of the printing plate is inserted in the clamping and locking mechanism 22 and clamped. By turning the plate cylinder 12 or 13, the printing plate is wound around that plate cylinder, until its trailing edge has also reached the clamping and locking mechanism 22, whereupon it is clamped and then locked.

Figure 2:
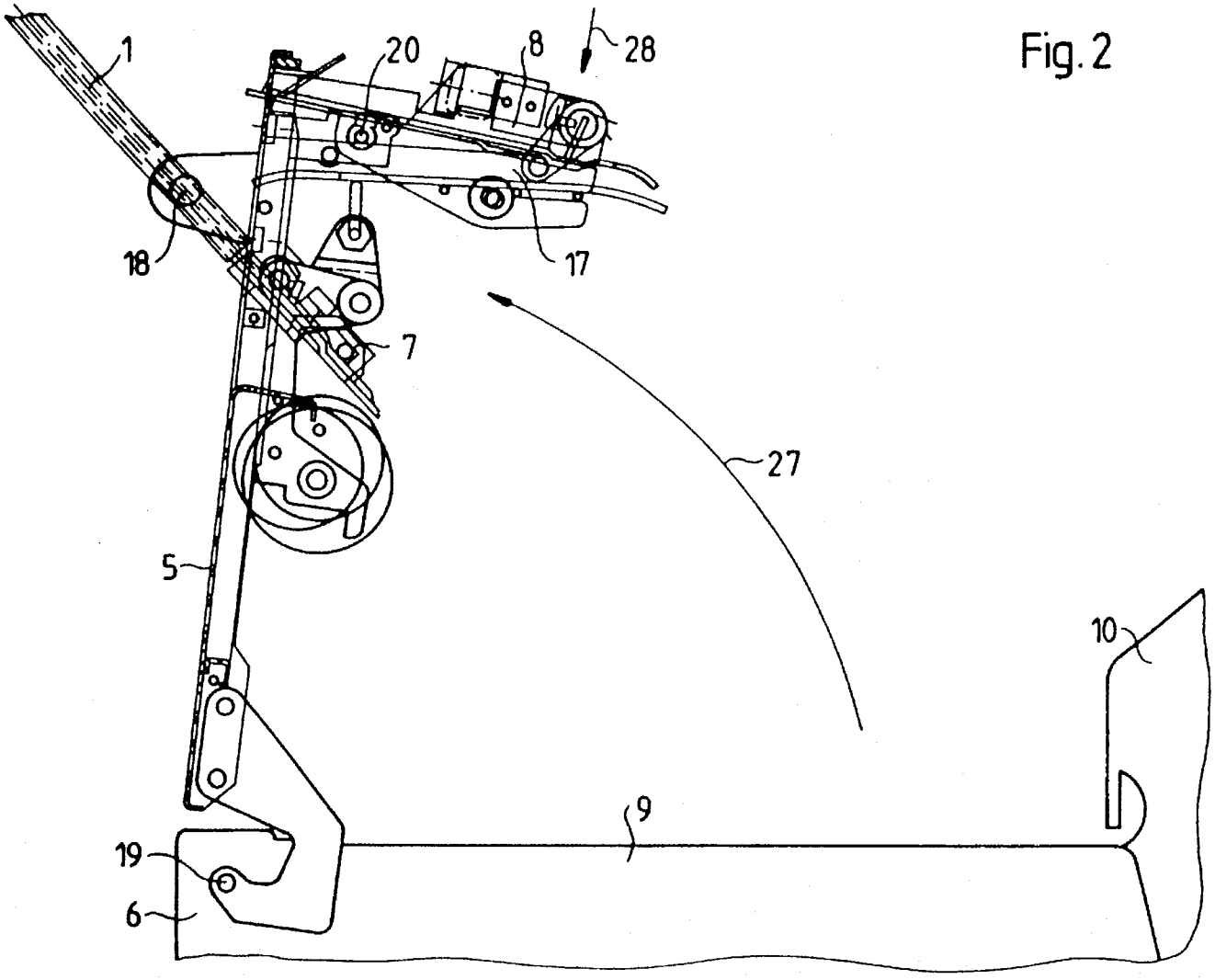
FIG. 2 is a partial side elevational view of a swivelable cylinder guard which carrying the device of the invention.

FIG. 2 shows a swivelable cylinder guard 5 which carries the device according to the invention. In order to perform work on the plate cylinders, for example cleaning or maintenance, the device according to the invention, consisting of the plate-holding device 1, the feed elements 7 and 8 and the discharge compartment 17, can be entirely swung out of the machine. The swivel motion is illustrated by the arrow 27. In this position the main printing unit 9 and the additional printing unit 10 are freely accessible. A swivel arrangement 19 is provided at the machine frame 6 for the swiveling of the cylinder guard 5. The feed element 8 and the discharge compartment 17 are fastened to the cylinder guard 5 by means of a swivel arrangement 20, in order to carry out a swivel motion 28 which is required when a swivel motion 27 of the cylinder guard 5 is carried out, so that the feed element 8 and the discharge compartment 17 will not abut against the additional printing unit 10.

FIG. 2 additionally shows the swivel arrangement 18 on the cylinder guard 5 of the plate-holding device 1 in its embodiment as a plate supply table 14.

It is understood that the exemplary embodiment described herein merely shows one possibility of constructing the device according to the invention. This plate-holding device can be brought into its various plate-changing positions in various ways, and it is feasible that by means of this plate-holding device a greater number of plate cylinders which, for example, may be disposed in planetary arrangement around a blanket cylinder, can be supplied with printing plates or the used printing plates be received.

We claim:

1. In combination with a printing press having a plurality of plate cylinders, a device for supplying printing plates to the plate cylinders of the printing press, comprising:

a plate-holding device disposed at the printing press for holding and guiding a printing plate, and means operatively associated with said plate-holding device for allowing said plate-holding device to be brought into different plate-changing positions at least two printing units, for selectively supplying printing plates to the at least two printing units, wherein the printing cylinders of the printing press have a cylinder guard, and said plate-holding device is swivellably mounted on said cylinder guard.

2. The device according to claim 1, which further comprises feed elements, said plate-holding device, in its plate-changing positions, being in operative engagement with said feed elements.

3. The device according to claim 1, wherein said plate-holding device is a plate feeding device and a plate discharge device for discharging plates from the printing units.

4. The device according to claim 3, wherein the plate-changing positions are each defined as both a plate supply position in which the printing plates are supplied to the printing unit and as a plate discharge position in which the printing plates are removed from the respective printing unit.

5. The device according to claim 1, which further comprises feed elements mounted on the cylinder guard, said plate-holding device, in its plate-changing positions, being in operative engagement with said feed elements.

6. The device according to claim 1, wherein the printing press includes a machine frame in which the printing unit is mounted, and the cylinder guard is swivelably mounted at the machine frame, and said plate holding device being swivellable out of the printing press together with the cylinder guard.

7. The device according to claim 2, which further comprises guiding tongues disposed on at least one of said feed elements for guiding the printing plates at lateral edges thereof.

8. In combination with a printing press having a plurality of plate cylinders, a device for supplying printing plates to the plate cylinders of the printing press, comprising:

a plate-holding device disposed at the printing press for holding and guiding a printing plate, and means operatively associated with said plate-holding device for allowing said plate-holding device to be brought into different plate-changing positions at least two printing units, for selectively supplying printing plates to the at least two printing units, wherein said plate-holding device is a plate supply table.

9. In combination with a printing press having a plurality of plate cylinders, a device for supplying printing plates to the plate cylinders of the printing press, comprising:

a plate-holding device disposed at the printing press for holding and guiding a printing plate, and means operatively associated with said plate-holding device for allowing said plate-holding device to be brought into different plate-changing positions at least two printing units, for selectively supplying printing plates to the at least two printing units, wherein said plate-holding device is a magazine for multiple printing plates.

10. In combination with a printing press having a plurality of plate cylinders, a device for supplying printing plates to the plate cylinders of the printing press, comprising:

a plate-holding device disposed at the printing press for holding and guiding a printing plate, and means operatively associated with said plate-holding device for allowing said plate-holding device to be brought into different plate-changing positions at least two printing units, for selectively supplying printing plates to the at least two printing units, wherein the printing units are mutually identical printing units, and whereby at least one of the printing units can be selectively brought into an engaged and a disengaged position by means of a swivel arrangement.

11. In combination with a printing press having a plurality of plate cylinders, a device for supplying printing plates to the plate cylinders of the printing press, comprising:

a plate-holding device disposed at the printing press for holding and guiding a printing plate, and means operatively associated with said plate-holding device for allowing said plate-holding device to be brought into different plate-changing positions at least two printing units, for selectively supplying printing plates to the at least two printing units, wherein the printing units, respectively, are a main printing unit and at least one additional printing unit, and wherein said at least one additional printing unit can be brought into a disengaged position.

12. In combination with a printing press having a plurality of plate cylinders, a device for supplying printing plates to the plate cylinders of the printing press, comprising:

a plate-holding device disposed at the printing press for holding and guiding a printing plate, and means operatively associated with said plate-holding device for allowing said plate-holding device to be brought into different plate-changing positions at least two printing units, for selectively supplying printing plates to the at least two printing units, which further comprises a plurality of position detection elements and control elements disposed in the printing machine such that said plate-changing device is steered into the respectively plate-changing positions in a most advantageous order.

13. The device according to claim 12, wherein said position detection elements include a microswitch connected to said plate-holding device for detecting a position of said plate-holding device, and wherein said control elements first bring a respective plate cylinder, at which said plate-holding device is in a working position, into the plate-changing position.

14. The device according to claim 7, wherein said guiding tongues are swivellably mounted.

15. In combination with a printing press having a plurality of plate cylinders, a device for supplying printing plates to the plate cylinders of the printing press, comprising:

a plate-holding device disposed at the printing press for holding and guiding a printing plate, and means operatively associated with said plate-holding device for allowing said plate-holding device to be brought into different plate-changing positions at least two printing units, for selectively supplying printing plates to the at least two printing units, which further comprises means defining a separate discharge compartment for receiving a used printing plate in at least one plate-changing position of said plate-holding device.

16. The device according to claim 15, wherein in one plate-changing position the printing plates are supplied to and discharged from the plate cylinder of the one printing unit from one side of the plate supply table, and, after swiveling of the plate supply table into the other plate-changing position the printing plate is supplied to the plate cylinder of the other printing unit from the other side of the plate supply table, and the printing plate is discharged from the other printing unit via said a separate discharge compartment.

* * * * *